United States Patent [19]

Kremer et al.

[11] Patent Number: 4,792,252

[45] Date of Patent: Dec. 20, 1988

[54] LIQUID APPLICATOR DEVICE

[75] Inventors: Leon V. Kremer, Crystal Lake; Ronald E. Kieras, Algonquin; Michael G. Knickerbocker, McHenry, all of Ill.

[73] Assignee: Pittway Corporation, Cary, Ill.

[21] Appl. No.: 832,658

[22] Filed: Feb. 25, 1986

Related U.S. Application Data

[63] Continuation-in-part of Ser. No. 741,537, Jun. 5, 1985, abandoned, and a continuation-in-part of Ser. No. 706,100, Feb. 27, 1985, abandoned.

[51] Int. Cl.[4] ..... B43K 5/08; B43K 8/00

[52] U.S. Cl. ..... 401/206; 401/205; 401/273

[58] Field of Search ..... 401/199, 206, 258–260, 401/264, 273, 186

[56] References Cited

U.S. PATENT DOCUMENTS

| | | | |
|---|---|---|---|
| 234,182 | 11/1880 | Hawkes | 401/260 |
| 3,233,275 | 2/1966 | Hansen et al. | 401/206 |
| 3,377,124 | 4/1968 | Matsumoto | 401/206 |
| 3,468,611 | 9/1969 | Ward | 401/206 |
| 3,640,631 | 2/1972 | Sotir | 401/206 |
| 4,480,940 | 11/1984 | Woodruff | 401/206 |

FOREIGN PATENT DOCUMENTS

| | | | |
|---|---|---|---|
| 170721 | of 1906 | Fed. Rep. of Germany | 401/273 |
| 3303341 | of 1984 | Fed. Rep. of Germany | 401/260 |
| 664679 | of 1964 | Italy | 401/206 |

*Primary Examiner*—Richard J. Apley
*Assistant Examiner*—Franklin Gubernick
*Attorney, Agent, or Firm*—Frijouf, Rust & Pyle

[57] ABSTRACT

A liquid applicator device and the method of making the applicator device is disclosed for applying a liquid such as a paint, a perfume, a chemical, a coating or the like to a surface by writing, marking or painting. The liquid applicator device includes a container for the liquid and an applicator dispensing mechanism. The applicator dispensing mechanism includes an inner subassembly having a valve and an outer subassembly having the surface applicator. The valve regulates the flow of the liquid from the container to the surface applicator. The valve of the applicator device may be opened to allow the liquid to flow from the container to the surface applicator upon depression of the surface applicator or upon depression of a valve actuator. The liquid applicator device incorporates an improved sealing member for sealing with the sides of the surface applicator for reducing the flow of the applicator liquid along the side of the surface applicator. The surface applicator may be in the form of a fiber tip, a brush or similar applicator. The applicator dispensing mechanism may be fabricated independent of the attachment to the container. The valve seal has a flexibly mounted tubular extension which holds the inner end of the surface applicator to maintain the liquid seal during lateral movement of the outer end of the surface applicator.

21 Claims, 6 Drawing Sheets

LIQUID APPLICATOR DEVICE

CROSS REFERENCE TO RELATED APPLICATIONS

This application is a continuation-in-part of U.S. patent application Ser. No. 741,537 filed June 5, 1985 now abandoned. U.S. patent application Ser. No. 741,537 filed June 5, 1985 is a continuation-in-part of U.S. patent application Ser. No. 706,100 filed Feb. 27, 1985 now abandoned. All matter set forth in abandoned patent application Ser. No. 741,537 filed June 5, 1985 and abandoned patent application Ser. No. 706,100 filed Feb. 27, 1985 is hereby incorporated by reference into the present application.

BACKGROUND OF THE INVENTION

1. Field of the Invention

This invention relates to the dispensing of liquids and more particularly, this invention relates to an improved applicator device for marking, writing or dispersing a liquid on a surface.

2. Description of the Prior Art

Various types of devices have been devised for marking or writing with ink, dye or paint. Among such devices are fountain pens, ball point pens, felt tip pens, capillary tube pens, fiber tip pens and the like. In addition, various other applicator devices have been devised in the prior art for applying and/or the dispersing a wide variety of other viscous and non-viscous liquid products such as perfumes, glues, insect repellants, oils, greases, lubricants and the like. The writing, marking and applicator devices of the prior art have received wide acceptance due in great measure to the convenience of the device and the ability to retain a large quantity of liquid in a liquid container. Further, the writing and applicator devices of the prior art have received wide acceptance due to the ability to supply additional applicator liquid from a liquid container to a surface applicator at the discretion of the user.

Continuing efforts have been made in the past to improve the design of applicator devices, particularly in the mechanism for improving the communication of the applicator liquid from the liquid container to the surface applicator for writing, marking or otherwise applying the applicator liquid on a surface. In a typical prior art applicator device, the applicator liquid flows to the surface applicator only when the applicator device is held upside down allowing the applicator liquid to flow to the surface applicator by action of gravity.

Prior to the advent of the present invention, there have been various problems in the design, fabrication, assembly and the utilization of applicator devices of the prior art. Most prior art devices incorporating a valve have required an excessively large number of parts. In general, the prior art applicator devices incorporating a valve had to be filled with the applicator liquid and then held in an upright orientation during the process of assembling the remainder of the applicator device. Accordingly, the completed but unassembled component parts of the liquid applicator device had to be shipped from a component parts manufacturer to a filling plant whereat the component parts had to be assembled concurrently with the filling of the containers. In general, the filling plants desire to undertake only the final assembly of a product as opposed to undertaking the entire assembly as required by the prior art applicator devices. This necessarily increased not only the total manufacturing cost, but also required the filling plant to provide an additional assembly line as well as to provide the quality control for the applicator device mechanism.

Accordingly, writing, marking and applicator devices of the prior art did not permit the assembly of the applicator mechanism independent of the final assembly at a filling plant. As a result of these and various other factors, the unit price for liquid applicator devices has been unnecessarily high.

It should be readily appreciated that the fabrication of the valve mechanism of an applicator device independent of the liquid container is a significant advancement in the art. The applicator device of the present invention allows for the fabrication and assembly of the applicator device mechanism from a single manufacturing site. Thereafter, the applicator device mechanism may be shipped to a filling plant whereat the liquid container may be filled with an applicator liquid. The applicator device mechanism may then be sealed to the filled liquid container. Furthermore, the improved applicator device of the present invention permits a user to separate the applicator device mechanism from a depleted liquid container without disassembling the applicator device mechanism. Consequently, the applicator device of the present invention could be refilled by the user to thereby extend the utility of applicator device and to further reduce the overall cost of the use of the applicator device.

In our prior patent application Ser. No. 706,100 filed Feb. 27, 1985, we disclosed a novel valve assembly suitable for use with a liquid dispensing device having a fiber tip surface applicator. In our continuation-in-part patent application Ser. No. 741,537 filed June 5, 1985, we disclosed a variation of the novel valve assembly which was suitable for use with a liquid dispensing device having either a fiber tip surface applicator or a brush surface applicator. In the present patent application, we have again improved upon the novel valve assembly through the incorporation of a superior sealing member interposed between the valve and the surface applicator which totally eliminates the need for a foam ring or foam disk sealer as required by most of the prior art devices. In addition, the novel sealing member of the present invention provides liquid seal between the valve and the surface applicator heretofore unknown in the art.

Therefore, it is an object of the present invention is to provide an improved applicator device for dispensing an applicator liquid wherein the applicator device mechanism may be constructed independently of the liquid container and subsequently coupled to the filled liquid container to form the completed applicator device.

Another object of the present invention is to provide an improved applicator device for dispensing an applicator liquid having an increased ease of assembly herein unknown in the prior art.

Another object of the present invention is to provide an improved applicator device for dispensing an applicator liquid which is more economical than the prior art applicator devices through the incorporation of component parts which permit the applicator device mechanism to be assembled by an assembly machine independent of the liquid container.

Another object of the present invention is to provide an improved applicator device for dispensing an applicator liquid which permits a user to separate the applicator device mechanism from a depleted liquid container without disassembling the applicator device mechanism for enabling the applicator device to be refilled by the user.

Another object of the present invention is to provide an improved applicator device for dispensing liquids such as inks, dyes, paints or chemicals and dispensing a wide variety of other types of viscous and non-viscous liquid products such as glues, insect repellants, oils, greases, lubricants, coating and the like.

Another object of the present invention is to provide an improved applicator device for dispensing an applicator liquid incorporating a surface applicator which permits a user to disperse the dispensed liquid on the surface.

Another object of the present invention is to provide an improved applicator device for dispensing an applicator liquid incorporating a valve for sealing the liquid container of the applicator device to prevent evaporation of the liquid in the liquid container.

Another object of the present invention is to provide an improved applicator device for dispensing an applicator liquid incorporating a valve that is moveable into an open position upon a user depressing a substantially rigid surface applicator on a surface.

Another object of the present invention is to provide an improved applicator device for dispensing an applicator liquid incorporating a valve that is moveable into an open position upon a user depressing a valve actuator for applying the liquid on a surface by a flexible surface applicator.

Another object of the present invention is to provide an improved liquid applicator device for dispensing an applicator liquid which provides an improved support for a surface applicator in the form of a fiber tip.

Another object of the present invention is to provide an improved liquid applicator device for dispensing an applicator liquid for use with a surface applicator in the form of a flexible applicator such as a paint brush or the like.

Another object of the present invention is to provide an improved applicator device for dispensing an applicator liquid incorporating a liquid container, a valve closure, a valve body, a valve element and bias means for sealing the liquid container and for dispensing and dispersing the liquid on the surface upon movement of the valve element into an open position.

Another object of the present invention is to provide an improved applicator device for dispensing an applicator liquid which is convenient for painting, marking, or applying a liquid to a surface.

Another object of the present invention is to provide an improved applicator device for dispensing an applicator liquid incorporating a novel sealing member having a superior seal between the valve and the surface applicator.

Another object of the present invention is to provide an improved applicator device for dispensing an applicator liquid incorporating a novel sealing member which is yieldable for maintaining a seal between the valve and a surface applicator irrespective of lateral movement or bending of the surface applicator relative to the valve.

Another object of the present invention is to provide an improved applicator device for dispensing an applicator liquid incorporating a novel sealing member which is suitable for use with a liquid dispensing device having either a fiber tip surface applicator or a brush surface applicator.

The foregoing has outlined some of the more pertinent objects and advantages of the present invention. These objects and advantages should be construed to be merely illustrative of some of the more pertinent features and applications of the intended invention. Many other beneficial results can be obtained by applying the disclosed invention in a different manner or modifying the invention within the spirit and scope of the disclosure. Accordingly, other objects and advantages and a fuller understanding of the invention may be had by referring to the Summary of the Invention and the Detailed Description describing the preferred embodiments in addition to the scope of the invention defined by the claims taken in conjunction with the accompanying Drawings.

SUMMARY OF THE INVENTION

The present invention is defined by the appended claims with the specific embodiments shown in the attached drawings. For the purpose of summarizing the invention, the invention may be incorporated into apparatus comprising a liquid applicator device for applying an applicator liquid from a liquid container to an applicator surface. In one embodiment of the present invention, the liquid applicator device includes an inner subassembly and an outer subassembly. The inner subassembly includes a valve being movable between an open position and a closed position for permitting and inhibiting the flow of the applicator liquid from the liquid container. The outer subassembly receives a surface applicator with a distal end of the surface applicator being exposed for applying the applicator liquid to the surface. A proximal end of the surface applicator communicates with the valve of the inner subassembly when the inner subassembly is secured to the outer subassembly. Axial depression of the distal end of the surface applicator causes displacement of the valve from the closed position to the open position to permit the flow of the applicator liquid from the liquid container to the proximal end of the surface applicator to enable the applicator liquid to flow to the distal end of the surface applicator.

In another embodiment of the invention, the liquid applicator device includes a valve having a valve element with the valve element being movable between an open position and a closed position. A valve closure has a first and a second end with an internal closure cavity extending therebetween. The valve closure receives a surface applicator having a proximal end and a distal end with the surface applicator being disposed in the internal closure cavity of the valve closure. The valve closure is connected to the valve with the proximal end of the surface applicator being disposed proximate the valve element and with the distal end of the surface applicator extending external the second end of the valve closure. The first end of the valve closure is connected to the liquid container for enabling the flow of the liquid from the liquid container to the surface applicator when the valve element is disposed in an open position. A seal means is provided for forming a liquid seal between the proximal end and the distal end of the surface applicator for directing the flow of the applicator liquid from the liquid container to the proximal end of the surface applicator.

In one specific embodiment of the invention, the seal means comprises a tubular portion slidably receiving the surface applicator for forming a liquid seal between the proximal end and the distal end of the surface applicator. In another embodiment of the invention, the seal means comprises a tubular portion slidably receiving the surface applicator which is flexibly mounted within the internal closure cavity of the valve closure to maintain the liquid seal between the tubular portion and the surface applicator irrespective of any deformation of the surface applicator.

In a more particular embodiment of the invention, the surface applicator is substantially cylindrical for cooperation with a cylindrical inner orifice of the tubular portion for slidably receiving the substantially cylindrical surface applicator. The means for flexibly mounting the tubular portion within the internal closure cavity of the valve closure preferably includes a resilient plastic extending portion secured to the valve seal. In one example of the invention, the resilient plastic extending portion is secured to the valve seal and the extending portion is secured to a generally central area of the tubular portion. Preferably, the resilient plastic extending portion is integrally formed with the valve seal and the tubular portion.

The applicator device may be used with a surface applicator which is substantially rigid such as a fiber tip or a flexible surface applicator such as a brush. In the case of a flexible surface applicator, a rigid valve actuator cooperates with the flexible applicator for moving the valve element from the sealing position to the open position upon depression of the valve actuator on a surface.

In another embodiment of the invention, the liquid applicator device comprises an inner subassembly and an outer subassembly. The inner subassembly includes a valve body, a valve element, a valve seal and bias means. The valve element is movable between an open position and a closed position. The outer subassembly includes a valve closure and a substantially cylindrical surface applicator. The valve closure has a first and a second end with an internal closure cavity extending therebetween. The surface applicator has a proximal end and a distal end with the surface applicator being disposed in the internal closure cavity of the valve closure. The outer subassembly includes a tubular portion flexibly mounted to the valve closure for slidably receiving the surface applicator for forming a liquid seal between the proximal end and the distal end of the surface applicator and for maintaining the liquid seal irrespective of any deformation of the surface applicator. The inner subassembly is connected to the outer subassembly with the proximal end of the surface applicator being disposed proximate the valve element and with the distal end of the surface applicator extending external the second end of the valve closure. The first end of the valve closure is secured to the liquid container for enabling the flow of the liquid from the liquid container to the surface applicator when the valve element is disposed in the open position.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature, objects and advantages of the invention, reference should be made to the following detailed description taken in connection with the accompanying drawings in which:

FIG. 2 is an enlarged sectional view of the liquid dispensing mechanism of FIG. 1 shown in a closed position;

Similar reference numerals refer to similar parts throughout the several views of the drawings.

DETAILED DISCUSSION

Figure 1:
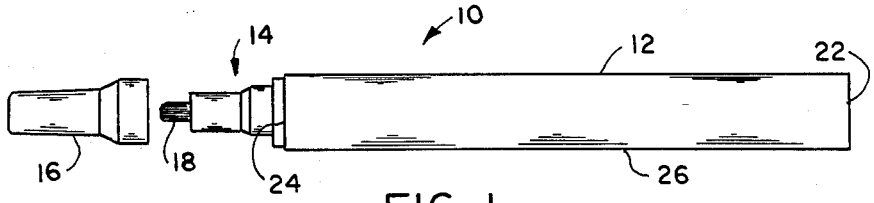
FIG. 1 is a side elevational view of a first embodiment of a liquid applicator device of the present invention.

FIG. 1 is an elevational view of a first embodiment of the present invention illustrating a liquid applicator device 10 comprising a liquid container 12, an applicator mechanism 14 and an overcap 16. The applicator mechanism 14 includes a surface applicator 18 shown as a fiber tip for applying an applicator liquid to a surface (not shown) upon the depression of the fiber tip 18 against the surface.

Figure 2:
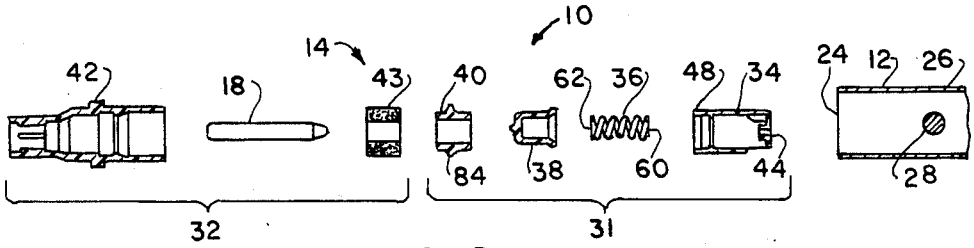
FIG. 2 is an exploded view illustrating the first embodiment of the liquid applicator device of FIG. 1.

FIG. 2 is an exploded view of a first embodiment of the present invention shown in FIG. 1. The liquid container 12 is preferably constructed of a non-permeable metallic or plastic substance and is provided with a closed end 22, an open end 24 and cylindrical side walls 26. The open end 24 is adapted to receive and store a quantity of applicator liquid. When the applicator device 10 is used to apply a marking liquid, the marking liquid may be formed of opaque particles suspended in a carrier liquid. The applicator device 10 may include agitator means 28 shown as a single ball but a plurality of balls or a metal slug may be disposed within the liquid container 12. Preferably, the agitator means 28 is formed of a metallic substance having a specific gravity significantly greater than the carrier liquid and with the metallic material being selected to minimize any chemical reaction with the carrier liquid. The agitator means 28 disburses the suspended opaque particles within the carrier liquid in the event that the suspended opaque particles have become precipitated or settled from the carrier liquid.

Figure 3:
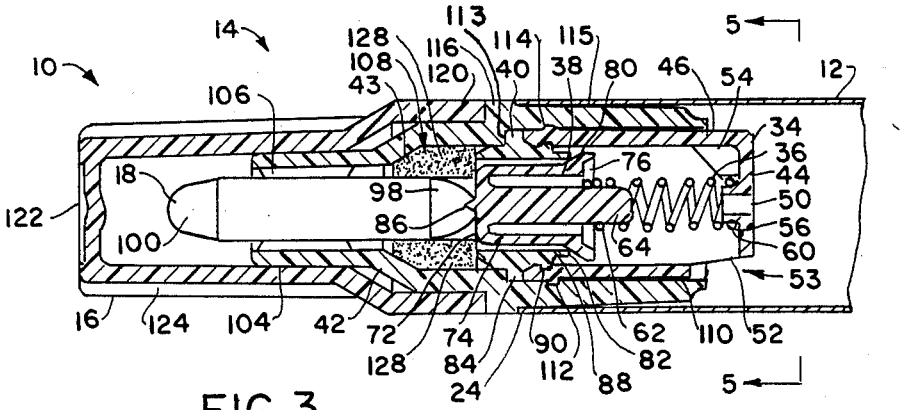
Figure 4:
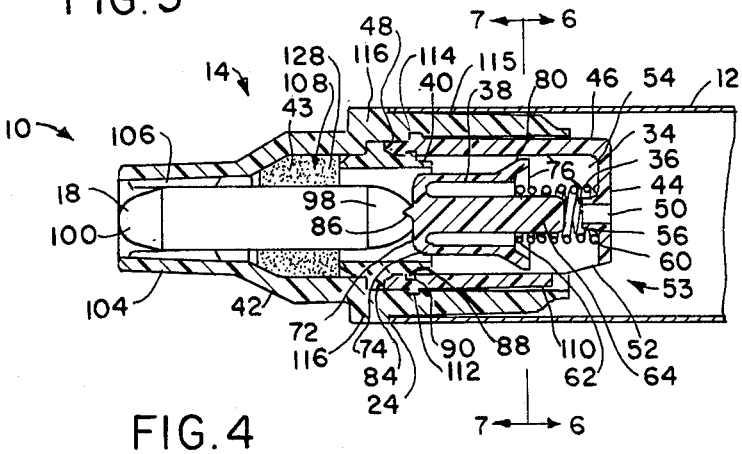
FIG. 4 is an enlarged sectional view of the liquid dispensing mechanism of FIG. 1 shown in an open position.

The dispensing mechanism 14 includes an inner subassembly 31 and an outer subassembly 32 as also shown in FIGS. 3–4. The inner subassembly 31 includes a valve body 34, bias means shown as a spring 36, a valve element 38 and a valve seal 40. The outer subassembly 32 comprises a valve closure 42, the surface applicator or fiber tip 18 and a foam collar 43. The valve body 34, the valve element 38, the valve seal 40 and the valve closure 42 are preferably formed of a plastic material or complementary plastic materials. The bias means is shown in this embodiment as a compression coil spring 36 which is preferably formed of stainless steel or another suitable material to preclude or minimize chemical reaction with the applicator liquid. Although the bias means has been shown as a compression coil spring 36 in the drawings, it should be understood that various other bias means may be used such as an integral plastic spring as disclosed in U.S. Pat. No. 4,471,893.

Figure 5:
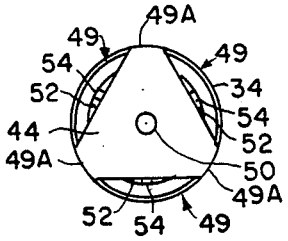
FIG. 5 is a partial enlarged sectional view along line 5—5 in FIG. 3 showing only a valve body.
Figure 6:
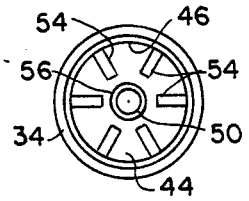
FIG. 6 is a partial enlarged sectional view along line 6—6 in FIG. 4 showing only the valve body.

As shown in greater detail in FIGS. 3, 4, 5 and 6, the valve body 34 is a cup-shaped configuration having a bottom face 44, cylindrical side walls 46 and an enlarged annular open top having a shoulder 48. The bottom face 44 of the valve body 34 is of a generally triangular shape defining voids 49 between the apices 49A of the triangle as shown in FIG. 5. In order to allow essentially unrestricted flow of the applicator liquid from the liquid container 12 into the valve body 34, the valve body 34 is provided with aperture means shown in this embodiment as a plurality of liquid passing apertures including an axial hole 50 and a plurality of slots 52. The hole 50 is disposed in the bottom face 44 whereas the plurality of slots 52 are formed transversely in the peripheral sidewalls 46 of the valve body 34. The slots 52 are located adjacent the voids 49 to form large flow openings 53 between the inside surface of the liquid container 12 and the valve body 34 to facilitate the flow of the applicator liquid therebetween. A plurality of spring orientating ribs 54 are formed in the valve body 34 and extend between an inside surface of the cylindrical sidewalls 46 and an inside surface of the bottom face 44 as shown in FIGS. 3, 4, and 6. The orientation ribs 54 enable the positioning of the coil spring 36 on a projection 56 extending from the bottom face 44 of the valve body 34. The projection 56 surrounds the axial hole 50 and frictionally engages the inner diameter of an inner spring end 60 of the coil spring 36. The inner diameter of an outer spring end 62 of the coil spring 36 is adapted to frictionally engage a projection 64 extending from the valve element 38.

Figure 7:
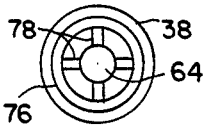
FIG. 7 is a partial enlarged sectional view along line 7—7 in FIG. 4 showing only a valve element.

The valve element 38 is formed in a cup-shape, with a closed face 72, circumferential side walls 74 and an open end 76. As also shown in FIG. 7, strengthening ribs 78 are located within the valve element 38 and extend from an inner surface of the closed face 72 to the open end 76 and terminate in the projection 64 which matingly engages with the inner diameter of the outer end 62 of the coil spring 36. A sealing surface 80 is formed on a flared peripheral shoulder located on an open end 76 of the valve element 38. A flexible sealing seat 82 is formed on the inner end of the valve seal 40. The diameter of the sealing surface 80 is greater than the diameter of the sealing seat 82. Spring 36 urges the reciprocal valve element 38 into a closed position as shown in FIG. 3 whereat the sealing surface 80 of the valve element 38 is in contact with the sealing seat 82 of the valve seal 40 to inhibit the flow of applicator liquid therethrough. The valve element 38 may be moved to an open position as shown in FIG. 4 whereat the sealing surface 80 of the valve element 38 is displaced from the sealing seat 82 of the valve seal 40 to permit the flow of applicator liquid therethrough. In this embodiment, the depression of fiber tip 18 will compress the spring 36 and displace the sealing surface 80 from the sealing seat 82 as shown in FIG. 4. The sealing surface 80 is made flexible by virtue of the thickness of the material and by virtue of the selection of the valve seat material. The valve element 38 has a point 86 for receiving and positioning an inner end of the surface applicator 18.

The valve seal 40 is generally cylindrically shaped and is provided with a circumferential shoulder 84 of a diameter greater than the remainder of the valve seal 40. The valve seal 40 is inserted into the valve body 34 with the valve element 38 and spring 36 located therebetween. The shoulder 84 of the valve seal 40 engages with the shoulder 48 of the valve body 34 to limit the depth of penetration of the valve seal 40 into the valve body 34. The shoulder 84 is substantially the same diameter as the diameter of the annular shoulder 48 of the valve body 34 enabling the first subassembly 31 to be inserted into the second subassembly 32. An annular projection 88 extends from the valve seal 40 whereas an annular recess 90 is disposed in the valve body 34. The annular projection 88 is received within the annular recess 90 in an interlocking engagement to couple the valve seal 40 to the valve body 34 to form the independent inner subassembly 31 of the dispenser mechanism. The valve seal 40 is preferably a plastic material such as polyethylene or other similar moldable material which will assume a rigid shape but be slightly more flexible than the polypropylene of the valve body 34 and valve element 38 to allow the inner and outer subassemblies 31 and 32 to be readily snapped together.

The outer subassembly 32 may be fabricated independently of the inner assembly 31 and the liquid container 12. The outer subassembly 32 of the first embodiment includes the surface applicator 18 shown as a substantially rigid fiber tip, the valve closure 42 and a foam disk shown in this embodiment as a cylindrical foam collar 43. The fiber tip 18 is a cylindrically shaped member formed of a highly compacted fibrous material such as polyester or other similar material having properties which enable the fiber tip 18 to hold the original shape when moistened with the applicator liquid while simultaneously being capable of passing the applicator liquid from a proximal or an inner end 98 to a distal or an outer end 100 of the fiber tip 18 by capillary action.

The valve closure 42 is a hollow element with an outer portion 104 having centering ribs 106 on the inner surface adapted to frictionally position and support the surface applicator 18. A central cylindrical portion 108 of the valve closure 42 is adapted to receive the foam collar 43. The foam collar 43 is formed as a hollow cylinder with an inner circumferential surface adapted to frictionally receive the surface applicator 18 therein. The exterior surface of the foam collar 43 is adapted to be frictionally received by the inner surface of the central portion 108 of the valve closure 42. In the alternative, a cylindrical disk may be disposed within the central portion 108 for contacting the inner end 98 of the surface applicator 18. In the case when a foam disk is used in place of the foam collar 43, the inner end 98 of the surface applicator 18 engages the foam disk. The surface applicator 18, valve closure 42 and the foam collar 43 comprise the independent outer subassembly 32.

The valve closure 42 has an inner portion 110 having a diameter greater than the remainder of the valve closure 42 which is provided with a circumferential inner recess 112 capable of receiving and positively retaining an annular projection 114 extending from the valve body 34 of the inner subassembly 31. In the assembled configuration, the shoulder 84 of the valve seal 40 engages with shoulder 113 of the valve closure 42. Accordingly, the inner and outer subassemblies 31 and 32 may be joined together into a snap locking engagement by an automatic machine process.

The applicator dispensing mechanism 14 is joined to the container 12 in this embodiment by a press fit engagement. The exterior diameter 115 of the valve closure 42 is tapered to be inserted into the open end 24 of the container 12. The exterior surface of the valve closure 42 is also provided with a shoulder 116 for engaging with the open end 24 of the container 12 to axially limit the movement of the dispensing mechanism 14 relative to the container 12.

The overcap 16 includes an inner end 120 having an internal diameter selected for providing a friction fit with the valve closure 42. The shoulder 116 of the valve closure 42 limits the movement of the overcap 16 on the valve closure 42. The overcap 16 has a closed outer end 122 positioned to avoid contact with the surface applicator 18 when the overcap 16 is positioned on the valve closure 42 as shown in FIG. 3. The overcap 16 may be provided with external gripping ribs 124 for aiding in the removal of the overcap 16 by a user. The valve closure 42 and the overcap 16 are preferably formed of acetal or a similar moldable material which will inhibit evaporation of any carrier liquid or solvent within the applicator material.

Preferably, the valve closure 42 and the overcap 16 are more rigid than the other elements of the applicator dispensing mechanism 14. The foam disk or collar 43 is preferably formed of an open cell, foaminous material to provide controlled flow of applicator liquid therethrough. The foam disk or collar 43 also functions as a reservoir to provide applicator liquid to a larger surface area of the surface applicator 18. The foam collar 43 further eliminates the need for keeping the valve mechanism continuously open during the dispensing process. The foam disk or collar 43, like all of the other elements of the liquid applicator device 10 is fabricated from a material which will not be adversely affected chemically when contacted by the applicator liquid.

As can be seen in FIGS. 3 and 4 the foam disk or collar 43 is located in a liquid chamber 128 defined by the valve element 38, the valve closure 42 and the surface applicator 18 whereby depression of the rigid fiber tip 18 will compress the spring 36 to separate the sealing surface 80 of the valve element 38 from the sealing seat 82 of the valve seal 40 as shown in FIG. 4. The separation of the sealing surface 80 of the valve element 38 from the sealing seat 82 of the valve seal 40 permits the flow of the applicator liquid by action of gravity from the container 12 through valve body 34 to the liquid chamber 128 and then to the surface applicator 18. The release of the depressing pressure from the rigid fiber tip 18 will return the sealing surface 80 of the valve element 38 into sealing engagement with the sealing seat 82 of the valve seal 40 as shown in FIG. 3 to inhibit the flow of the applicator liquid from the container 12 to the rigid fiber tip 18.

Figure 8:
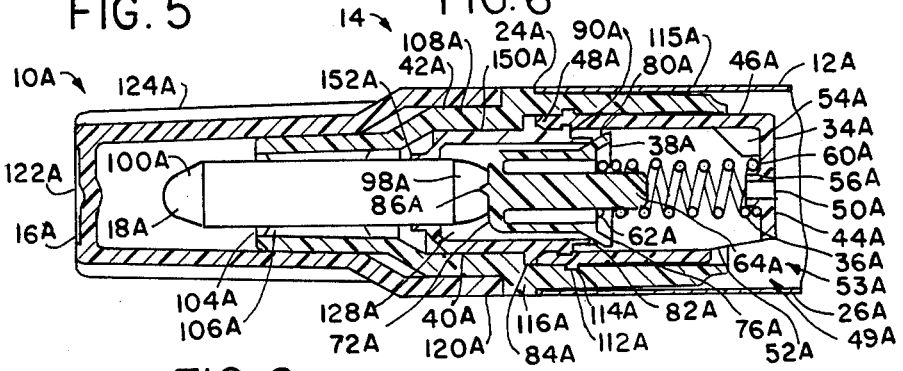
FIG. 8 is an enlarged sectional view of a second embodiment of the liquid dispensing mechanism shown in a closed position.
Figure 9:
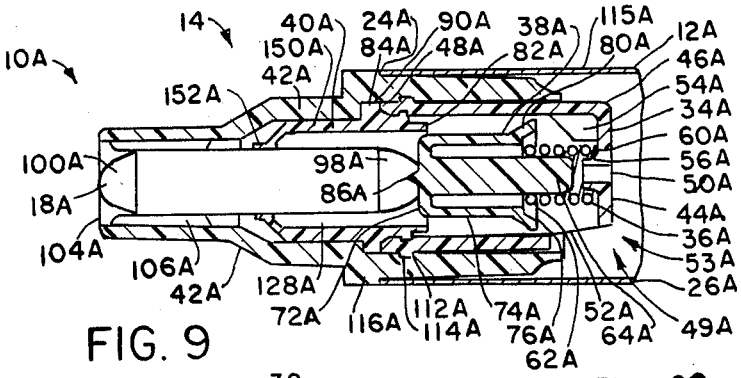
FIG. 9 is an enlarged sectional view of the second embodiment of the liquid dispensing mechanism shown in an open position.

FIGS. 8 and 9 illustrate a second embodiment of the invention shown in FIGS. 2–7. In this second embodiment, the liquid dispensing mechanism 10A is identical to the mechanism heretofore described with similar parts being labeled with similar reference numerals followed by the letter A. In this embodiment the valve seal 40A includes an extending portion 150A having an inwardly projecting wall 152A for contacting the surface applicator 18A. The extending portion 150A and the inwardly projecting wall 152A create a chamber 128A which functions as a liquid reservoir for the inner end 98A of the rigid fiber tip 18A to replace the reservoir created by the foam collar 43 in FIGS. 2–4. The inwardly projecting wall 152A acts as a seal for the liquid chamber 128A and prevents the flow of the applicator liquid along the side of the surface applicator 18A. The projecting wall 152A further stabilizes the felt tip 18A. This contribution to the art not only reduces the number of required parts and cost, but also facilitates the manufacturing process since the foam disk or collar 43 has been the most difficult element to handle in the assembly of the liquid applicator device 10. In the manufacture of the prior art liquid applicator devices, the sponge-like characteristics of the foam collar 43 often required the foam collars to be inserted in a hand operation. The elimination of the foam collar 43 from the liquid applicator device 10 and the associated manufacturing process thus permits the entire fabrication and assembly process to be readily done on totally automated machinery. The embodiment shown in FIGS. 8 and 9 provide superior performance and eliminates the need for any foam which was required in many of the prior art devices.

Figure 10:
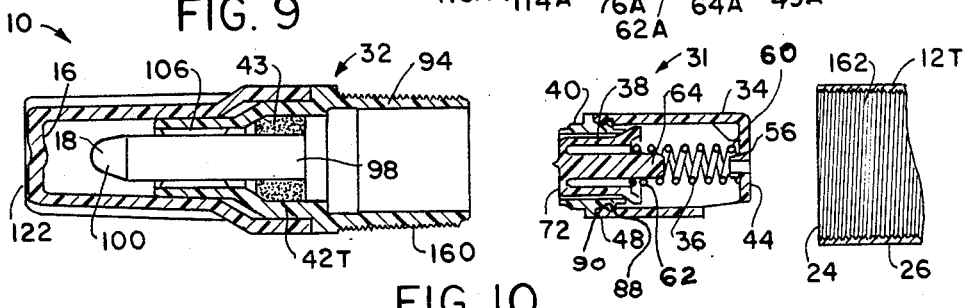
FIG. 10 illustrates the first step in a method of forming the liquid dispensing mechanisms of the present invention.
Figure 11:
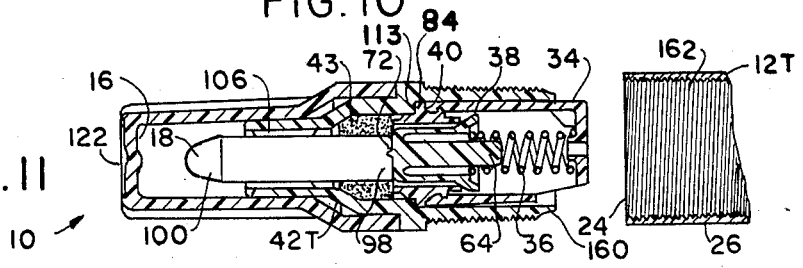
FIG. 11 illustrates the second step in the method of forming the liquid dispensing mechanisms of the present invention.

FIGS. 10 and 11 illustrate in greater detail the method of assembling the liquid applicator devices of the present invention as described heretofore and described hereinafter. FIG. 10 shows the coil spring 36 being frictionally attached to the cup-shaped body 34 with the inner diameter of the inner spring end 60 being received on the projection 56 of the inner surface of the bottom face 44 of the valve body 34. The projection 64 extending from the valve element 38 is then axially placed into a frictional engagement with the inner diameter of the outer spring end 62 of the spring 36. The valve seal 40 is then axially press fit against the shoulder 48 of the valve body 34 with recess 90 of the valve body 34 receiving projection 88 of the valve seal 40 as best shown in FIGS. 3 and 4. As also shown in FIG. 10, the cylindrical foam collar 43 is frictionally located over the surface applicator 18 and the outer end 100 of the surface applicator 18 is inserted into the internal centering ribs 106 of the cylindrical valve closure 42. The outer end 100 of the surface applicator 18 is exposed for applying the liquid to the surface whereas the inner end of the surface applicator within the valve closure 42 is adapted to contact the closed face 72 of the valve element 38.

As shown in FIG. 11, the inner subassembly 31 and the outer subassembly 32 are mated to one another with shoulder 84 of the valve seal 40 engaging shoulder 113 of the valve closure 42 and with the projection 114 of the valve body 34 being received within the recess 112 of the valve closure 42 as best shown in FIGS. 3 and 4. The overcap 16 may optionally be inserted onto the completed applicator dispensing mechanism 14 comprising the inner subassembly 31 and the outer subassembly 32.

The applicator dispensing mechanism 14 comprising the inner and outer subassemblies 31 and 32 and preferably with the overcap in place may then be shipped to a filling plant wherein the applicator liquid is placed within the container 12. Preferably, the exterior diameter 115 of the valve closure 42 is press fit into the open end 24 of the container 12 as shown in FIGS. 1–9. In the second embodiment, the liquid applicator devices 10A is fabricated and assembled in a manner similar to the first embodiment. The inner subassembly 31A is fabricated in a similar manner. However in the outer subassembly 32A, the step of inserting the foam collar 43 is omitted from the fabrication process. In the second embodiment, the inner end 98A of the surface applicator 18A is axially inserted into the extending wall 152A of the valve seal 40A. The inner subassembly 31A and the outer subassembly 32A are mated to one another as heretofore described.

The liquid applicator device of the present invention may readily be used for marking or writing in a manner similar to conventional writing devices or may readily be used to apply other liquids such as perfumes, chemicals, lubricants or most any other desired liquid. With the removal of the overcap 16, the surface applicator 18 is exposed for applying the applicator liquid on the desired surface in a conventional manner. When a user determines that the supply of applicator liquid to the surface applicator 18 has become insufficient, the user can supply additional applicator liquid to the surface applicator 18. The additional applicator liquid is supplied to the surface applicator 18 by holding the applicator device 10 with the surface applicator 18 below the container 12 and simultaneously depressing the fiber tip 18 against a surface. The surface applicator 18 will slide axially into the valve closure 42 thereby axially moving the valve element 38 against the force of the spring 36 to separate the sealing surface 80 of the valve element 38 from the sealing seat 82 of the valve seal 40. The applicator liquid may then flow from the container 12 under the influence of gravity through the slots 52 and hole 50 of the valve body 34 around the sealing surface 80 of the valve element 38 into the liquid chamber 128 for contacting the surface applicator 18.

In the first embodiment, the foam collar 43 in the liquid chamber 128 functions as a seal to preclude the flow of applicator liquid other than through the surface applicator 18. The foam collar 43 also assists in conveying the applicator liquid to a broader surface area of the surface applicator. The second embodiment 10A is void of the foam collar 43 and therefore the applicator liquid flows directly into a liquid chamber 128A for contacting the inner end 98A of the surface applicator 18. The projecting wall 152A precludes the movement of the applicator liquid therebeyond.

When the inner end 98 of the surface applicator 18 has received additional applicator liquid, the additional applicator liquid migrate along the entire length of the surface applicator 18 by capillary action. Accordingly, an operator can maintain an optimum amount of the applicator liquid on the outer end 100 of the surface applicator 18 over an extended period of time.

FIGS. 10 and 11, also show a variation of the first embodiment wherein the valve closure 42T also comprises threads 160 for engaging with threads 162 on the container 12T. The use of a threaded engagement between the valve closure 42T and the container 12T enables the operator to unscrew the applicator dispensing mechanism 14 from the container 12T and to refill the container 12T with the applicator liquid. When the container 12T eventually has been depleted of applicator liquid, the dispensing mechanism may be readily separated from the container 12T, if desired, and refilled with applicator liquid and then be reassembled. During such process, the elements of the dispensing mechanism 14 are retained in an assembled condition independent of the coupling to the container 12T. In prior art devices, the dispensing mechanism would not be maintained in an assembled condition since the interconnection between the container and dispensing mechanism secures the elements of the dispensing mechanism. Although a press fit and a threaded engagement have been shown herein, it should be appreciated by those skilled in the art that various other means may be incorporated for securing the container to the applicator mechanism 14.

Figure 12:
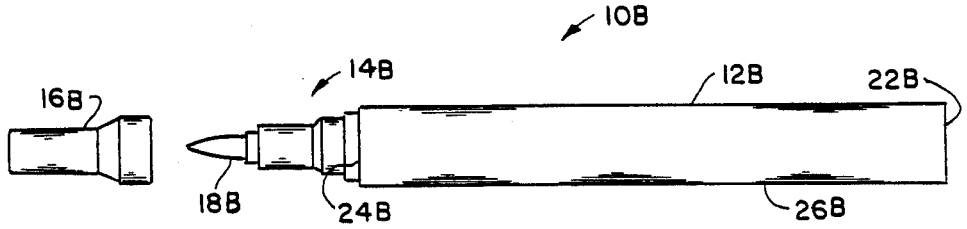
FIG. 12 is a side elevational view of a third embodiment of a liquid applicator device of the present invention.

FIG. 12 is an elevational view of a third embodiment of the present invention illustrating a liquid applicator device 10B comprising a liquid container 12B, an applicator mechanism 14B and an overcap 16B. The applicator mechanism 14B includes a surface applicator 18B shown as a flexible brush for applying an applicator liquid to the surface.

Figure 13:
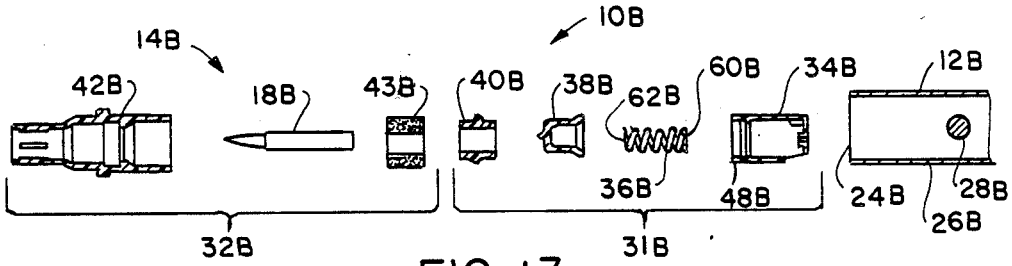
FIG. 13 is an exploded view illustrating the third embodiment of the liquid applicator device of FIG. 12.
Figure 14:
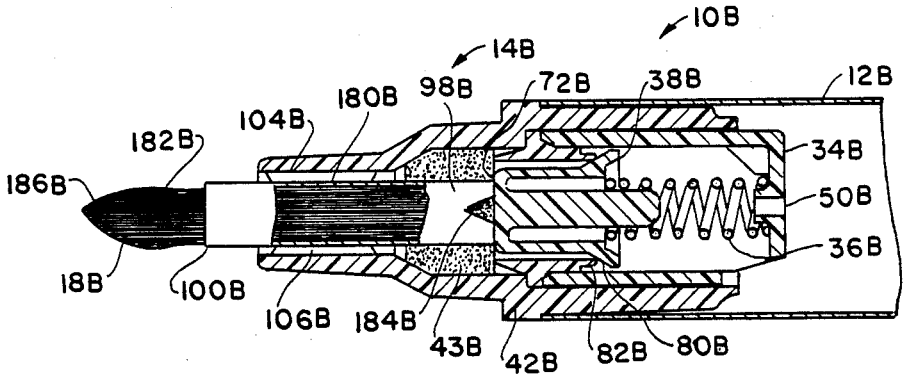
FIG. 14 is an enlarged sectional view of the liquid dispensing mechanism of FIG. 12 shown in a closed position.
Figure 15:
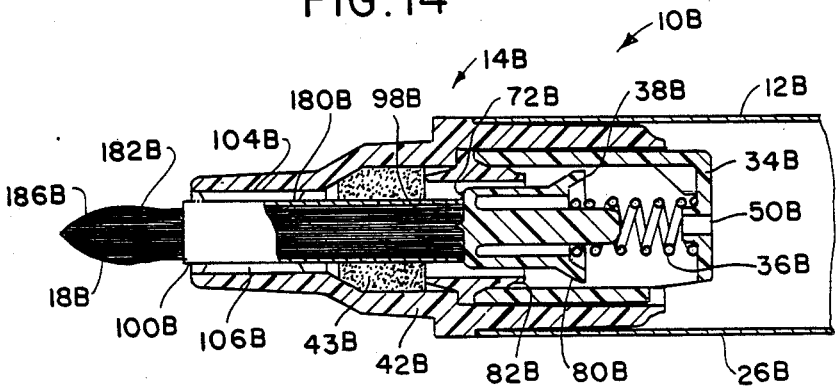
FIG. 15 is an enlarged sectional view of the liquid dispensing mechanism of FIG. 12 shown in an open position.

FIG. 13 is an exploded view of the third embodiment of the invention shown in FIG. 12. The dispensing mechanism 14B includes an inner subassembly 31B and an outer subassembly 32B which are also shown in FIGS. 14 and 15. The inner subassembly 31B includes a valve body 34B, bias means shown as a spring 36B, a valve element 38B and a valve seal 40B. The outer subassembly 32B comprises a valve closure 42B, the surface applicator brush 18B and the foam collar 43B. The third embodiment of FIGS. 12–15 is similar to the first embodiment shown in FIGS. 1–7 with similar parts being labeled with the same reference numerals followed by the letter B. In the third embodiment 10B, the surface applicator comprises a valve actuator 180B and a brush 182B disposed within the valve actuator 180B. The valve actuator 180B is preferably formed of a plastic tubular material with the fibers of the brush 182B being retained within the valve actuator 180B by means that should be well known to those skilled in the art. The valve actuator 180B may include a single actuator orifice 184B or a plurality of valve actuator orifices 184B disposed adjacent the proximal or inner end 98B of the valve actuator 180B. The valve actuator orifice 184B enables the passage of the actuator liquid from the foam collar 43B to the fibers of the brush 182B. The applicator liquid may then flow by capillary action from the inner end 98B to the outer end 100B of the valve actuator 180B to migrate to a distal end 186B of the brush 182B. The valve actuator 180B is movable within the outer portion 104B of the valve closure 42B and is guided by the ribs 106B in a manner similar to the fiber tip 18 of FIGS. 1–11. Since the brush 182B is flexible, the valve actuator 180B is used to move the valve element 38A from the closed position as shown in FIG. 14 to the open position as shown in FIG. 15. The valve actuator 180B may be conveniently moved by pressing the outer end 100B of the valve actuator 180B against a surface such as an edge of the overcap 16B or any other convenient surface. The applicator mechanism 14B and the function of the valve element 38B operates in the same manner as the applicator mechanism 14 and the valve element 38 previously described with reference to FIGS. 1–7.

Figure 16:
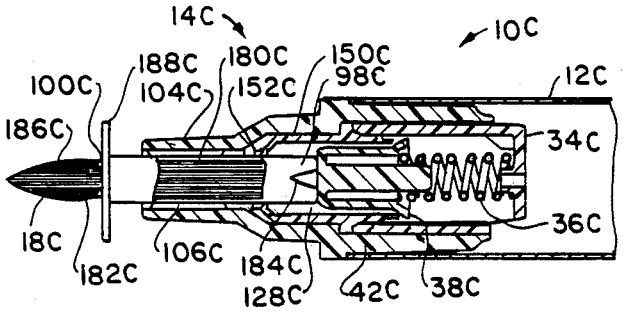
FIG. 16 is an enlarged sectional view of a fourth embodiment of the liquid dispensing mechanism shown in a closed position.
Figure 19:
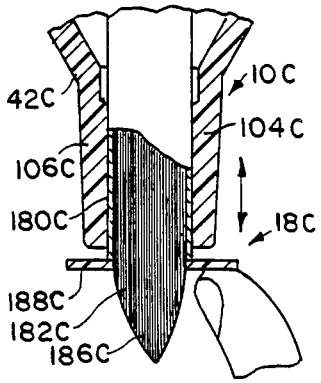
FIG. 19 illustrates the movement of a valve actuator shown in FIGS. 16–18 by the finger of a user.
Figure 17:
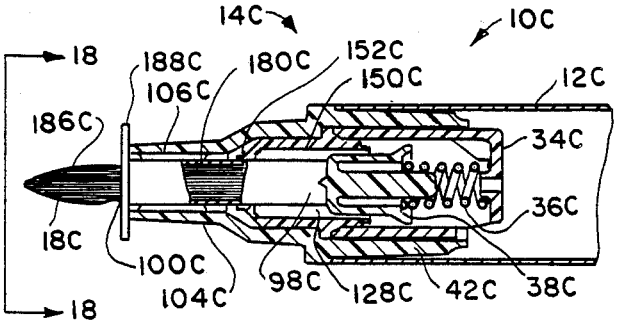
FIG. 17 is an enlarged sectional view of the fourth embodiment of the liquid dispensing mechanism shown in an open position.
Figure 18:
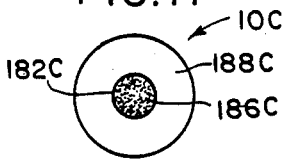
FIG. 18 is a view along line 18—18 in FIG. 17.

FIGS. 16 and 17 illustrate a fourth embodiment of the invention which is similar to the third embodiment shown in FIGS. 12–15 with similar parts being labeled with the same reference numerals follow by the letter C. In the fourth embodiment 10C, the surface applicator comprises a valve actuator 180C and a brush 182C disposed within the valve actuator 180C. The valve actuator 180C includes a valve actuator orifice 184C disposed adjacent a proximal or inner end 98C of the valve actuator 180C. The valve actuator orifice 184C enables the passage of the actuator liquid from the liquid chamber 128C formed by the extending portion 150C and the projecting wall 152C to the fibers of the brush 182C. The applicator liquid may then flow by capillary action from the proximal or inner end 98C through a distal or outer end 100C of the valve actuator 180C to a distal end 186C of the brush 182C. The valve actuator 180C is movable within the outer portion 104C of the valve closure 42C and is guided by the ribs 106C in a manner similar to FIGS. 12–15. The projecting wall 152C of the extending portion 150C form a sliding seal with the valve actuator 180C to direct the applicator liquid to the valve actuator orifice 184C. In a manner similar to FIGS. 12–15, the valve actuator 180C is used to move the valve element 38C from the closed position as shown in FIG. 16 to the open position as shown in FIG. 17. In this embodiment, the valve actuator 180C includes a contact member 188C shown in greater detail in FIGS. 18 and 19. The contact member 188C is shown as a disk integrally formed with the tubular portion of the valve actuator 180C but it should be understood that the contact member 188C may take various forms and shapes and may be an independent unit secured to the tubular portion of the valve actuator 180C by various means. The contact member 188C aids the user by providing a large area in which to contact a surface for displacing the valve actuator 180C inwardly to displace the valve element 38C as heretofore described. The applicator mechanism 14C and the function of the valve element 38C operates in the same manner as the applicator mechanism 14A and the valve element 38A previously described with reference to FIGS. 8 and 9.

Figure 20:
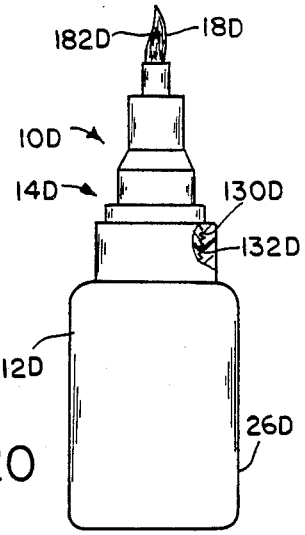
FIG. 20 is an elevational view of a fifth embodiment of the present invention illustrating the dispensing mechanism in combination with a flexible wall container.

FIG. 20 is a side view partially in section of a fifth embodiment of the present invention illustrating a liquid applicator device 10D comprising a liquid container 12D, an applicator mechanism 14D and an overcap (not shown). The applicator mechanism 14D includes a surface applicator 18D for applying the applicator liquid to the surface. Although the surface applicator 18D has been shown comprising a brush 182D, other surface applicators may be used including the fiber tip 18 shown in FIGS. 1–7.

In the fifth embodiment, the valve closure 42D also comprises threads 130D for engaging with threads 132D on the liquid container 12D. The use of a threaded engagement between the applicator mechanism 14D and the container 12D enables the user to unscrew applicator mechanism 14D from the liquid container 12D and to refill the liquid container 12D with the applicator liquid as heretofore described.

The applicator device 10D also includes a flexible wall container 12D which is preferably a flexible plastic container enabling the user to reduce the internal volume of the container 12D by squeezing or otherwise flexing the container sidewall 26D. The applicator mechanism 14D in combination with the flexible wall container 12D allows the user to dispense the applicator liquid under pressure. The dispensing of the applicator liquid under pressure enables the dispensing of viscous liquids such as glues, gels and other viscous materials. Although the means of dispensing the applicator liquid under pressure has been shown as a flexible wall liquid container 12D, it should be understood that various other means may be used to reduce the internal volume of the liquid container.

Figure 21:
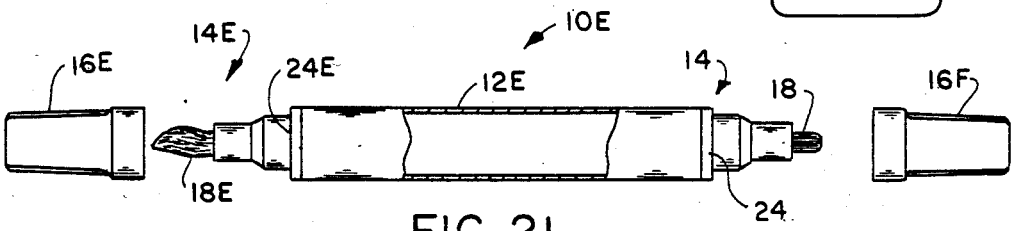
FIG. 21 is a side elevational view partially in section of a sixth embodiment of the present invention illustrating an applicator device having plural surface applicators for dispensing a single applicator liquid.

FIG. 21 is a side elevational view partially in section of a sixth embodiment of the present invention illustrating an applicator device 10E having a first surface applicator 18 on a first end 24 of a liquid container 12E and a second surface applicator 18E on a second end 24E of the liquid container 12E. In this embodiment, the first applicator mechanism 14 and the first surface applicator 18 are identical to the first or second embodiments shown in FIGS. 1–11 whereas the second applicator mechanism 14E and the second surface applicator 18E utilize a brush applicator device as shown in FIGS. 12–15. In this embodiment, the liquid container 12E contains a common applicator liquid for dispensing through each of the first and second surface applicators 18 and 18E.

Figure 22:
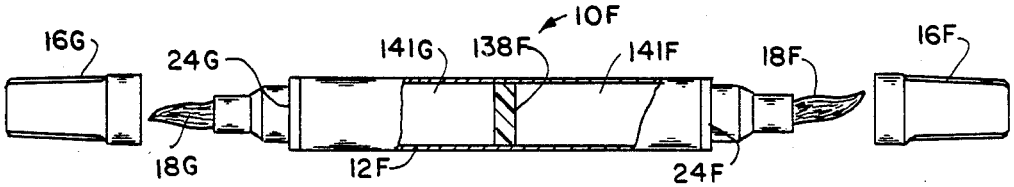
FIG. 22 is a side elevational view partially in section of a seventh embodiment of the present invention illustrating an applicator device having plural surface applicators for dispensing plural applicator liquids.

FIG. 22 is a side elevational view partially in section of a seventh embodiment of the present invention illustrating an applicator device 10F having a first surface applicator 18F on one end 24F of a liquid container 12F and a second surface applicator 18G on a second end 24G of the liquid container 12F. In this embodiment, the liquid container 12F contains an intermediate wall 138F to separate the liquid container 12F into a first and a second container portion 141F and 141G to respectively receive a first and a second applicator liquid for dispensing through the first and second surface applicators 18F and 18G, respectively. The intermediate wall 138F may be an independent unit which is inserted into a tubular container or may be integrally formed with the container.

Figure 23:
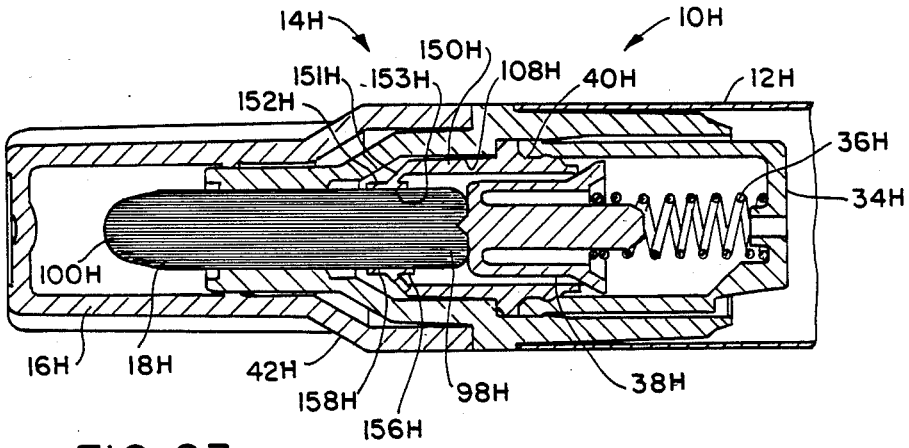
FIG. 23 is a side sectional view of an eighth embodiment of the liquid dispensing mechanism shown in a closed position and incorporating an improved seal for the surface applicator.
Figure 24:
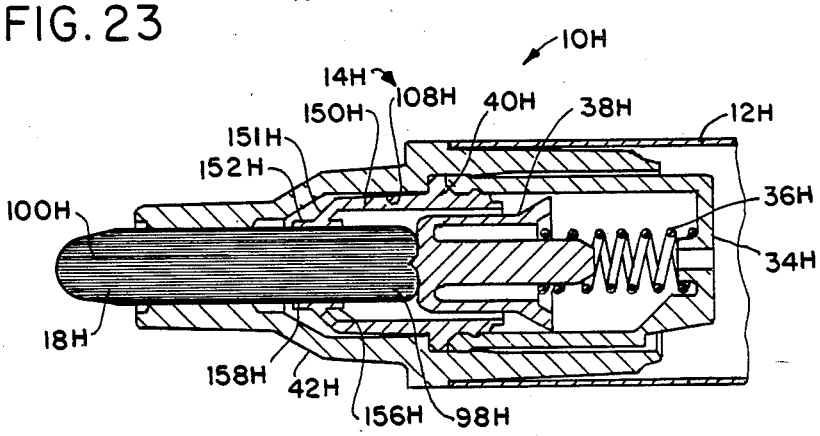
FIG. 24 is a side sectional view of the eighth embodiment of the liquid dispensing mechanism of FIG. 23 shown in an open position.

FIG. 23 and 24 are side sectional views in a closed and an open position of an eighth embodiment of the invention illustrating a liquid marking device 10H which is similar to the mechanism described in FIGS. 8 and 9 with similar parts being labeled with similar reference numerals followed by the letter H. In this embodiment, the valve seal 40H includes an extending portion 150H having a flexible mounting wall 151H for flexibly supporting a tubular portion 152H. The tubular portion 152H is flexibly mounted within the internal closure cavity 108H of the valve closure 42H by a resiliency in the plastic of the flexible mounting wall 151H located between the tubular portion 152H and the valve seal 40H. The tubular portion 152H slidably receives the surface applicator 18H and forms a liquid tight seal between the proximal end 98H and the distal end 100H of the surface applicator 18H and prevents the flow of the applicator liquid along the side of the surface applicator 18H. In addition, the extending portion 150H, the flexible mounting wall 151H and the tubular portion 152H create a chamber 128H which functions as a liquid reservoir for the inner end 98H of the surface applicator 18H to replace the reservoir created by the foam collar 43 in FIGS. 2–4.

Preferably, the surface applicator 18H is substantially cylindrical with the tubular portion 152H having a cylindrical inner orifice 153H for slidably receiving the substantially cylindrical surface applicator 18H. In this embodiment, the flexible mounting wall 151H is integrally formed with the valve seal 40H, the extending portion 151H and the tubular portion 152H and is secured to a central area of the tubular portion 152H. Accordingly, the tubular portion 152H comprises an inner tubular portion 156H and an outer tubular portion 158H.

The resiliency in the plastic of the flexible mounting wall 151H enables the tubular portion 152H to pivot within the internal closure cavity 108H of the valve closure 42H to maintain the liquid tight seal between the tubular portion 152H and the surface applicator 18H irrespective of any deformation of the surface applicator 18H. In addition, the extending portion 150H, the flexible mounting wall 151H and the tubular portion 152H stabilizes the inner end 98H of the surface applicator 18H.

In the prior art marking devices, an operator will in some cases add excessive pressure to the surface applicator when the surface applicator is pressed against a surface. An excessive pressure on the surface applicator caused the surface applicator to deform thereby destroying the seal between the surface applicator and the valve closure. Accordingly, the excess pressure resulted in excess liquid leaking along the outer surface of the surface applicator. If the surface applicator was already substantially saturated with the liquid, the excess liquid could not be absorbed by the surface applicator and would run along the side of the surface applicator to the surface. The operator was then required to clean the excessive liquid from the surface applicator before continuing the marking process. This inconvenience was a major disadvantage of the prior art marking devices.

Figure 25:
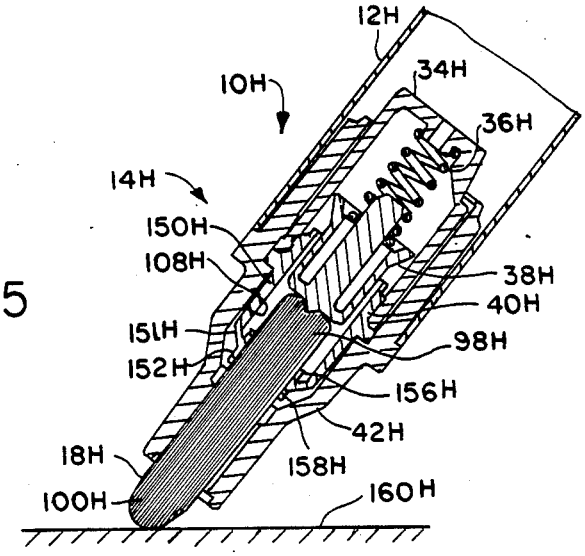
FIG. 25 is a side sectional view of the eighth embodiment of the liquid dispensing mechanism of FIGS. 23 and 24 showing a deformation of the surface applicator due to the surface applicator contacting a surface.

FIG. 25 illustrates a side sectional view of the liquid applicator device 10H for applying an applicator liquid to a surface 160H. FIG. 25 also illustrates an operator applying excessive pressure to the surface applicator 18H as the surface applicator 18H is pressed against a surface 160H causing deformation of the surface applicator 18H. In contrast to the prior art applicator devices, the flexible mounting wall 151H enables the pivoting of the tubular portion 152H within the internal closure cavity 108H as shown in FIG. 25 to maintain a liquid tight seal between the tubular portion 152H and the surface applicator 18H irrespective of any deformation of the surface applicator 18H. Accordingly, an excessive pressure applied to the present invention does not destroy the seal and does not result in excess liquid leaking along the outer surface of the surface applicator 18H. The embodiment shown in FIGS. 23–25 provides superior performance to the prior art applicator devices and eliminates the inconvenience caused by leaking which was a major disadvantage of the prior art marking devices.

Figure 26:
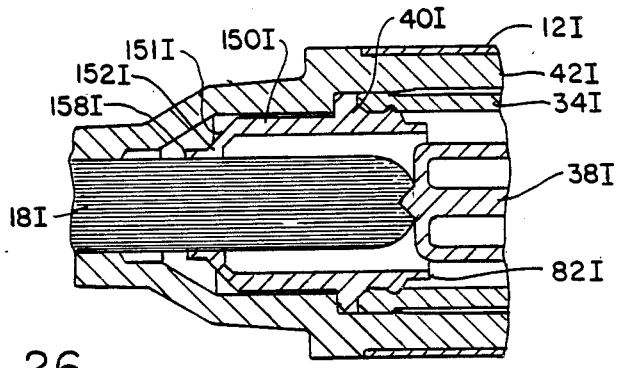
FIG. 26 is an enlarged partial side sectional view of the seal shown in FIGS. 8 and 9.
Figure 27:
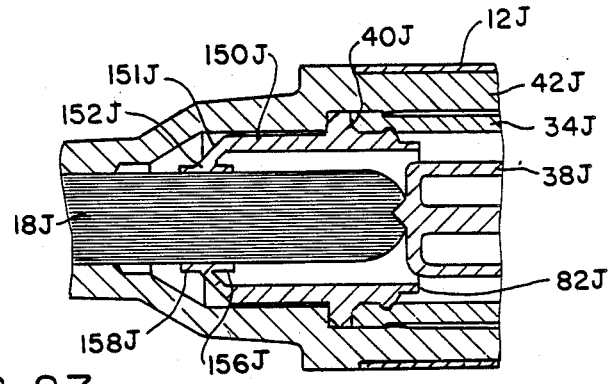
FIG. 27 is an enlarged partial side sectional view of the seal shown in FIGS. 23–25.

FIG. 26 is an enlarged partial side sectional view of the seal shown in FIGS. 8 and 9 whereas FIG. 27 is an enlarged partial side sectional view of the seal shown in FIGS. 23–25. In the embodiment shown in FIG. 26, the tubular portion 152I is devoid of an inner tubular portion and comprises only an outer tubular portion 158I. In the embodiment shown in FIG. 27, the tubular portion 152J comprises both an inner tubular portion 156J and an outer tubular portion 158J. In the embodiment shown in FIG. 28, the tubular portion 152K is devoid of an inner tubular portion and comprises a modified outer tubular portion 158K. In the embodiment shown in FIG. 29, the tubular portion 152L comprises an inner tubular portion 156I and is devoid of an outer tubular portion.

The various embodiments set forth in FIGS. 26–29 illustrate different structures which are preferably used with different surface applicators and different applicator liquids. The tubular portion 152J shown in FIG. 27 has the greatest axial length and is the most suited for use with non-viscous liquids and/or surface applicators having a liquid impermeable valve actuator such as the valve actuator 180B shown in FIGS. 12–15. The greater axial length of the tubular portion 152J provides a greater distance for non-viscous liquids to migrate along the side of the surface applicator 18J. Furthermore, the greater axial length of the tubular portion 152J provides increased surface to inhibit the migration of non-viscous liquids along the side of the surface applicator 18J. However, the greater axial length of the tubular portion 152J produces greater friction between the tubular portion 152J and the surface applicator 18J and accordingly requires a stronger spring to properly return the sealing surface into sealing engagement with the sealing seal 82J.

Figure 29:
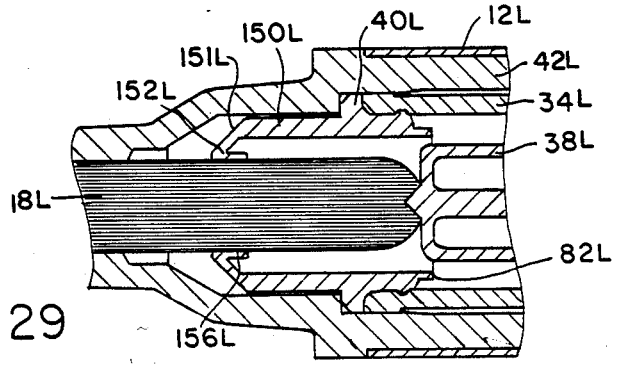
FIG. 29 is an enlarged partial side sectional view of a modification of the seals shown in FIGS. 26–28.

The embodiment shown in FIGS. 26 and 29 have equivalent axial lengths with the tubular portion 152I having only the outer tubular portion 158I and with tubular portion 152L having only the inner tubular portion 156L. The embodiments shown in FIGS. 26 and 29 provides suitable sealing for non-viscous liquids without requiring stronger springs to properly return the sealing surfaces into sealing engagement with the sealing seats 82I and 82L.

Figure 28:
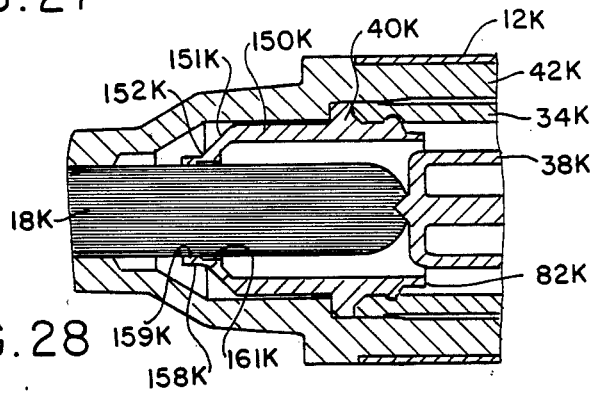
FIG. 28 is an enlarged partial side sectional view of a modification of the seal shown in FIGS. 8 and 9.

In the embodiment shown in FIG. 28, the tubular portion 152K has the least axial length and is the most suited for viscous liquids and/or surface applicators without a liquid impermeable valve actuator such as the valve actuator 180B shown in FIGS. 12–15. In this embodiment, the outer tubular portion is undercut at 161K to define an annular seal 159K for engaging the surface applicator 18K. The shorter axial length of the tubular portion 152K produces the least friction between the tubular portion 152K and the surface applicator 18K. Accordingly, the embodiment shown in FIG. 28 provides suitable sealing for viscous liquids and requires the weakest springs to properly return the sealing surface into sealing engagement with the sealing seat 82K. Although the various embodiments set forth in FIGS. 26–29 illustrate different structures which are preferably used with different surface applicators and different applicator liquids, each of the embodiments shown in FIGS. 26–29 provide a superior seal to the foam collar or disk 43 shown in FIGS. 1–4.

When the applicator devices disclosed herein and the applicator devices of the prior art are subjected to an open valve condition for a prolonged period of time, the applicator liquid will attempt to migrate along the sides of the surface applicator. An open valve condition in this specification exists when the applicator device is in an operating position and the surface applicator is depressed against the applicator surface for an extended period of time. Under an open valve condition, the applicator liquid tends to migrate or flood along the sides of the surface applicator. The applicator liquid that ultimately floods or migrates along the sides of the surface applicator results in an excessive amount of applicator liquid being applied to the applicator surface. The excessive amount of applicator liquid that is applied to the applicator surface is extremely undesirable since the excessive amount of applicator liquid is uncontrolled by the surface applicator and is accordingly uncontrollable by an operator.

Accordingly, a test was devised to determine the amount of excessive applicator liquid that ultimately floods or migrates along the sides of the surface applicator and is deposited on the applicator surface. The test measured the weight loss of the applicator device with the applicator liquid within the liquid container when the applicator device was subjected to an open valve condition multiple times. The weight loss represents the weight of the applicator liquid that is applied to the applicator surface. An applicator device having a higher weight loss will have a higher amount of excessive applicator liquid that floods or migrates along the sides of the surface applicator and is deposited on the applicator surface.

Table A illustrates the results of a test between the applicator device 10 shown in FIGS. 1–4 incorporating the foam collar 43 and the applicator device 10H having the tubular portion 152H shown in FIGS. 23–25. Each of the applicator devices 10 and 10H were filled with the same quantity of applicator liquid and were each intermittantly (1) weighed, (2) subjected to an open valve condition for fifteen seconds, (3) subjected to a closed valve condition and (4) weighed. Each of the applicator devices 10 and 10H was subjected to the open valve condition thirty-six (36) times.

TABLE A

| Trial No. | FIGS. 23–25 | FIGS. 1–4 |
|---|---|---|
| 1 | 12.94 grams | 12.84 grams |
| 2 | 12.94 | 12.81 |
| 3 | 12.93 | 12.78 |
| 4 | 12.92 | 12.77 |
| 5 | 12.91 | 12.75 |
| 6 | 12.90 | 12.72 |
| 7 | 12.89 | 12.68 |
| 8 | 12.88 | 12.67 |
| 9 | 12.87 | 12.62 |
| 10 | 12.87 | 12.60 |
| 11 | 12.86 | 12.56 |
| 12 | 12.85 | 12.52 |
| 13 | 12.84 | 12.49 |
| 14 | 12.84 | 12.47 |
| 15 | 12.82 | 12.45 |
| 16 | 12.82 | 12.41 |
| 17 | 12.82 | 12.40 |
| 18 | 12.81 | 12.37 |
| 19 | 12.80 | 12.35 |
| 20 | 12.80 | 12.34 |
| 21 | 12.80 | 12.31 |
| 22 | 12.79 | 12.31 |
| 23 | 12.79 | 12.28 |
| 24 | 12.78 | 12.27 |
| 25 | 12.78 | 12.24 |
| 26 | 12.77 | 12.22 |
| 27 | 12.77 | 12.19 |
| 28 | 12.77 | 12.17 |
| 29 | 12.77 | 12.15 |
| 30 | 12.76 | 12.12 |
| 31 | 12.75 | 12.10 |
| 32 | 12.74 | 12.06 |
| 33 | 12.74 | 12.74 |
| 34 | 12.74 | 12.74 |
| 35 | 12.73 | 11.99 |
| 36 | 12.73 | 11.98 |
| TOTAL LOSS | | |
| | 0.21 grams | 0.86 grams |
| LARGEST AMOUNT LOST BETWEEN TRIALS | | |
| | 0.02 grams | 0.05 grams |

The above test illustrates that the applicator device 10H having the tubular portion 152H shown in FIGS. 23–25 had significantly less weight loss than the applicator device 10 shown in FIGS. 1–4 incorporating the foam collar 43. The applicator device 10H lost a total weight of 0.21 grams of applicator liquid whereas the applicator device 10 lost a total weight of 0.86 grams of applicator liquid. Since the amount of applicator liquid lost (0.21 grams) by the applicator device 10H was sufficient to provide a suitable coating on the applicator surface, then the amount of applicator liquid lost (0.86 grams) by the applicator device 10 that is greater than 0.21 grams represents the excessive amount of applicator liquid that is applied to the applicator surface. The excessive amount (0.65 grams) of applicator liquid that was applied on the applicator surface is the undesirable and uncontrollable applicator liquid. Furthermore, the above test illustrates that the applicator device 10H produces a more efficient use of the applicator liquid than the applicator device 10. Accordingly, applicator device 10H will have a longer useful life than the the applicator device 10.

Similar tests were performed on the various embodiments set forth in FIGS. 26–29. The embodiment shown in FIG. 27 has the greatest axial length and experienced the least weight loss. The embodiments shown in FIGS. 26 and 29 have equivalent axial lengths and experienced an equal weight loss which was greater than the weight loss experienced by the embodiment shown in FIG. 27. The embodiment shown in FIG. 28, has the least axial length and experienced the greatest weight loss. However, each of the embodiments shown in FIGS. 26–29 providing a superior seal to the foam collar or disk 43 shown in FIGS. 1–4.

Although the present invention is primarily suited for the application of a marking liquid such as ink, paint or the like to a writing surface, the present invention also finds many other useful functions in the dispensing or application of other liquid. The present inventions may be used to apply a variety of liquid such as insect repellants, perfumes, lubricants, chemicals or any other suitable liquids. In addition, the various embodiments set forth herein may be altered and interchanged to produce an applicator device for a particular use as should be well known to those skilled in the art.

The present disclosure includes that contained in the appended claims as well as that of the foregoing description. Although this invention has been described in its preferred forms or embodiments and methods with a certain degree of particularity, it is understood that the present disclosure of the preferred form has been made only by way of example and that numerous changes in the details of construction fabrication and use and including the combination and arrangement of parts and steps may be resorted to without departing from the spirit and scope of the invention.

What is claimed:

1. A liquid applicator device for applying a liquid from a liquid container to a surface, comprising in combination;

a valve having a valve element and a valve seal;

said valve element being movable between a closed position wherein said valve element engages said valve seal and an open position wherein said valve element is displaced from said valve seal;

a valve closure having a first and a second end with an internal closure cavity extending therebetween;

a surface applicator having a longitudinal length terminating in a proximal end and a distal end;

said surface applicator being disposed in said internal closure cavity of said valve closure;

means connecting said valve closure to said valve with said proximal end of said surface applicator being disposed proximate said valve element and with said distal end of said surface applicator extending external said second end of said valve closure;

means connecting said first end of said valve closure to said liquid container for enabling the flow of the liquid from the liquid container to said surface applicator when said valve element is disposed in said open position; and a tubular portion slidably receiving said surface applicator for forming a liquid seal between said proximal end and said distal end of said surface applicator during movement of said surface applicator parallel to said longitudinal length of said surface applicator; and a resilient plastic extending portion unitary with said valve seal for flexibly mounting said tubular portion within said internal closure cavity of said valve closure to maintain the liquid seal between said tubular portion and said surface applicator during deformation of said surface applicator perpendicular to the longitudinal length thereof.

2. An improved applicator device as set forth in claim 1, wherein said surface applicator is substantially flexible for dispersing the applicator liquid on the surface.

3. The liquid applicator device as set forth in claim 1, wherein said surface applicator is substantially cylindrical; and said tubular portion includes a cylindrical inner orifice for slidably receiving said substantially cylindrical surface applicator.

4. An improved applicator device as set forth in claim 3, wherein said means connecting said first end of said valve closure to said container includes said valve closure being press fitted into an open end of said container.

5. The liquid applicator device as set forth in claim 1, wherein said resilient plastic extending portion is secured to a generally central area of said tubular portion.

6. The liquid applicator device as set forth in claim 1, wherein said resilient plastic extending portion is integrally formed with and secure to an end of said tubular portion.

7. The liquid applicator device as set forth in claim 1, wherein said surface applicator is substantially rigid.

8. The liquid applicator device as set forth in claim 7, wherein said surface applicator is a fiber tip.

9. The liquid applicator device as set forth in claim 1, wherein said surface applicator is a flexible applicator; and a rigid valve actuator cooperating with said flexible applicator for moving said valve element from said closed position to said open position upon depression of said valve actuator on a surface.

10. The liquid applicator device as set forth in claim 9, wherein said flexible surface applicator is a brush applicator.

11. The liquid applicator device as set forth in claim 1, wherein said means connecting said first end of said valve closure to said liquid container includes a press fit engagement.

12. An improved applicator device as set forth in claim 1, wherein said container is substantially rigid.

13. An improved applicator device as set forth in claim 1, wherein said container includes means for reducing the volume of said container to force the applicator liquid from said container through said applicator opening to said surface applicator when said valve element is in said open position.

14. An improved applicator device as set forth in claim 13, wherein said means for reducing the volume of said container includes said container having a resilient flexible container wall.

15. A liquid applicator device for applying a liquid from a liquid container to a surface, comprising in combination;

a valve having a valve body, a valve element and a valve seal;

said valve seal having a sealing surface for cooperation with said valve element;

means connecting said valve seal to said valve body;

said valve element being movable between a closed position wherein said valve element engages said sealing surface of said valve seal and an open position wherein said valve element is displaced from said sealing surface of said valve seal;

bias means for biasing said valve element into said closed position;

a valve closure having a first and a second end with an internal closure cavity extending therebetween;

a surface applicator having a longitudinal length terminating in a proximal end and a distal end;

said surface applicator being disposed in said internal closure cavity of said valve closure;

means connecting said valve closure to said valve body with said proximal end of said surface applicator engaging said valve element and with said distal end of said surface applicator extending external said second end of said valve closure;

means connecting said first end of said closure to said liquid container for enabling the flow of the liquid from the liquid container to said valve body;

said surface applicator being longitudinally movable along said longitudinal length upon depression of said distal end of said surface applicator on the surface for moving said valve element from said closed position to said open position for enabling the flow of the liquid from said valve body to said surface applicator;

a tubular portion slidably receiving said surface applicator for forming a liquid seal between said proximal end and said distal end of said surface applicator during said longitudinal movement of said surface applicator; and said valve seal having a unitary resilient plastic extending portion for flexibly mounting said tubular portion within said internal closure cavity of said valve closure to maintain said liquid seal between said tubular portion and said surface applicator during deformation of said surface applicator due to lateral movement of said surface applicator.

16. The liquid applicator device as set forth in claim 15, wherein said means connecting said valve body to said valve seal includes a recess disposed in one of said valve body and said valve seal for receiving a projection extending from the other of said valve body and said valve seal.

17. The liquid applicator device as set forth in claim 15, wherein said means connecting said valve closure to said valve body includes a recess disposed in one of said valve closure and said valve body for receiving a projection extending from the other of said valve closure and said valve body.

18. The liquid applicator device as set forth in claim 15, wherein said valve seal comprises an annular sealing surface; and said valve element comprises an annular shoulder for engaging with said annular sealing surface.

19. The liquid applicator device as set forth in claim 15, and further including aperture means located in said valve body for permitting the flow of applicator liquid from said liquid container to said surface applicator.

20. An improved applicator device as set forth in claim 15, wherein said means for connecting said first end of said valve closure to said container includes thread means.

21. A liquid applicator device for applying a liquid from a liquid container to an applicator surface, comprising in combination;

a valve comprising a valve body, a valve element, a valve seal and bias means;

a valve closure having a first and a second end with an internal closure cavity extending therebetween;

a surface applicator having a proximal end and a distal end with said surface applicator being disposed in said internal closure cavity of said valve closure;

means connecting said valve closure to said valve with said proximal end of said surface applicator engaging said valve element and with said distal end of said surface applicator extending external said second end of said valve closure;

said valve element being movable between a closed position and an open position for respectively inhibiting and permitting the flow of the applicator liquid from the liquid container to said surface applicator;

said bias means biasing said valve element into said closed position with said valve element being in sealing engagement with said valve seal;

said valve seal having an extending portion for supporting a substantially tubular portion;

said tubular portion slidably receiving said surface applicator for forming a liquid seal therebetween;

means connecting said first end of said valve closure to said liquid container enabling said surface applicator to move said valve element from said sealing position to an open position upon depression of said distal end of said surface applicator on the applicator surface enabling the flow of the applicator liquid from said container to said surface applicator; and said extending portion of said valve seal flexibly supporting said tubular portion for maintaining the liquid seal between said tubular portion and said surface applicator irrespective of any deformation of said surface applicator.

* * * * *

UNITED STATES PATENT AND TRADEMARK OFFICE

CERTIFICATE OF CORRECTION

PATENT NO. : 4,792,252

DATED : December 20, 1988

INVENTOR(S) : Kremer et al.

It is certified that error appears in the above-identified patent and that said Letters Patent is hereby corrected as shown below:

Column 6, line 17, delete "Fig. 2" and insert therefor --Fig. 3--.

Column 22, line 12, delete "an applicator" and insert therefor --a--.

Signed and Sealed this

Thirteenth Day of June, 1989

*Attest:*

DONALD J. QUIGG

*Attesting Officer*

*Commissioner of Patents and Trademarks*